US005619817A

United States Patent [19]

Jones

[11] Patent Number: 5,619,817

[45] Date of Patent: Apr. 15, 1997

[54] LOCK FOR HAND HELD WEAPON

[76] Inventor: David W. Jones, 4271 Skywalker Ave., Las Vegas, Nev. 89120

[21] Appl. No.: 415,565

[22] Filed: Apr. 3, 1995

[51] Int. Cl.[6] ..... F41A 17/04

[52] U.S. Cl. ..... 42/70.01; 42/70.08; 42/66

[58] Field of Search ..... 42/66, 70.01, 70.06, 42/70.07, 70.08, 70.11

[56] References Cited

U.S. PATENT DOCUMENTS

| | | | |
|---|---|---|---|
| 4,135,320 | 1/1979 | Smith | 42/70.01 |
| 4,467,545 | 8/1984 | Shaw, Jr. | 42/70.01 |
| 5,090,148 | 2/1992 | Brooks | 42/70.11 |

OTHER PUBLICATIONS

Grob, Bernard, Basic Electronics, pp. 256–260. 1984.

*Primary Examiner*—Michael J. Carone
*Attorney, Agent, or Firm*—Tod R. Nissle, P.C.

[57] ABSTRACT

A method and apparatus for preventing the unauthorized firing of a hand held weapon. The apparatus includes an electrically operated locking system which prevents the firing of a weapon and which, in use, consumes only small amounts of electrical energy. An electrical relay in the apparatus does not consume electrical energy while in the open or the closed position.

20 Claims, 5 Drawing Sheets

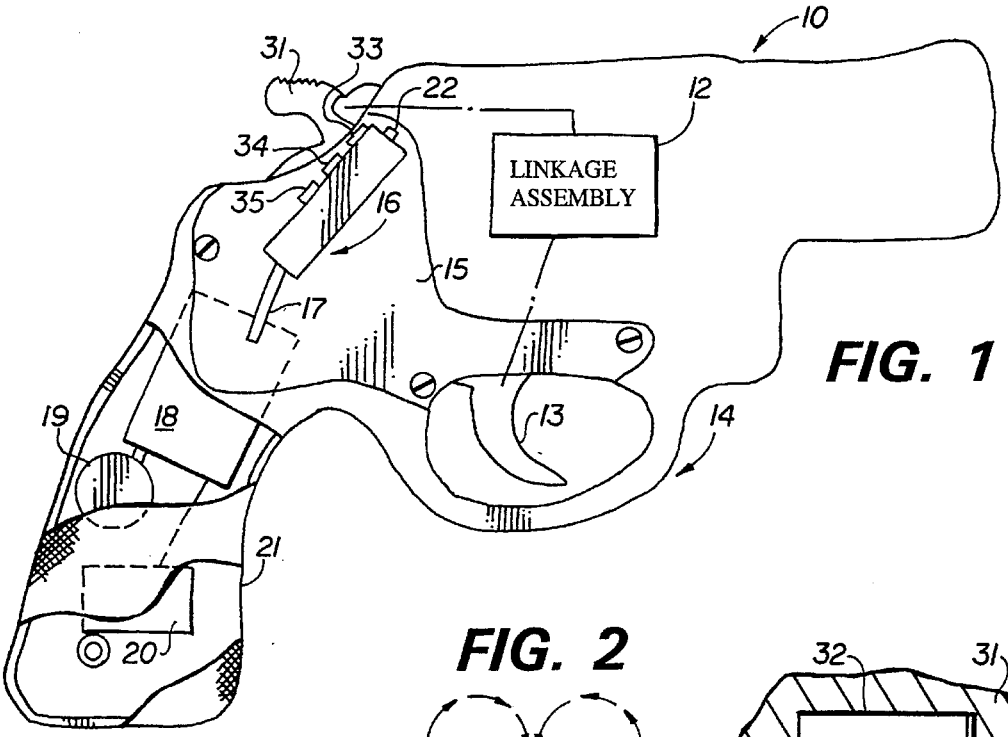
FIG. 1
FIG. 2
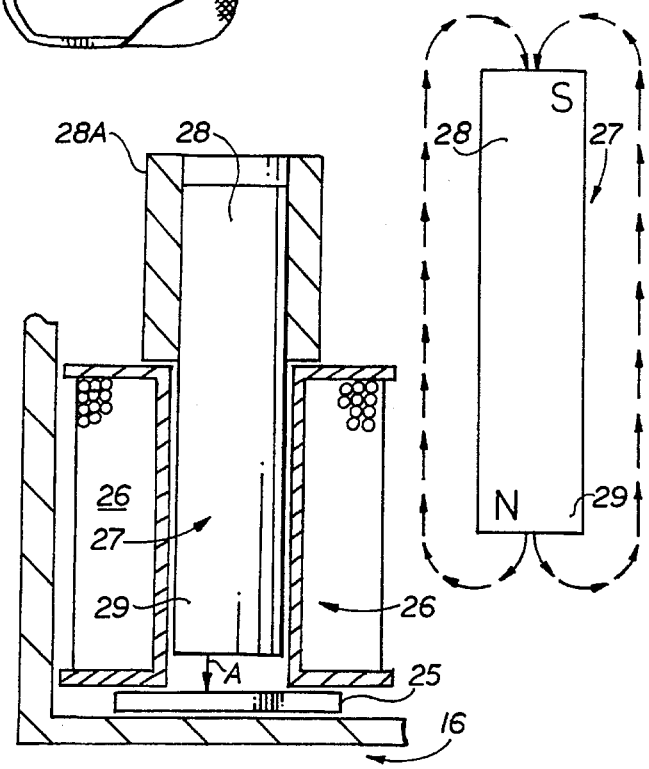
FIG. 3
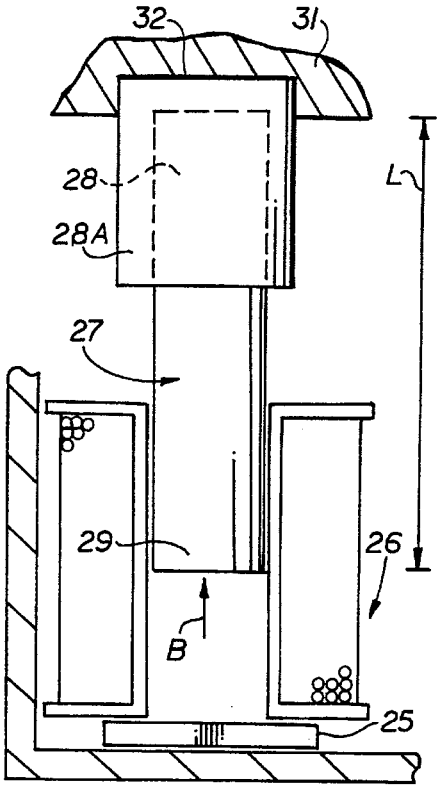
FIG. 4

LOCK FOR HAND HELD WEAPON

This invention relates to hand held weapons.

More particularly, the invention relates to a method and apparatus for preventing the unauthorized firing of a hand held weapon.

In a further respect, the invention relates to an electrically operated locking system which prevents the firing of a weapon and which, in use, consumes only small amounts of electrical energy.

In another respect, the invention relates to an electrical relay which does not consume electrical energy while in the open or the closed position.

Systems for preventing the unauthorized discharge of a firearm are well known in the art. For example, U.S. Pat. No. 4,467,545 to Shaw, Jr. discloses a locking system for a hand gun. The locking system utilizes a solenoid to move a steel pin attached to a spring against and away from the hammer of the gun. When the spring pushes the pin against the hammer, the gun cannot be fired. When the steel pin is moved away and spaced apart from the hammer, the gun can be fired. The solenoid is powered by a small battery carried in the hand gun. The principal drawback of the Shaw, Jr. locking system is that the solenoid steadily consumes electrical energy from the battery as long as the steel pin is maintained in a position spaced apart from the hammer of the gun. Such steady consumption of electrical energy can require frequent replacement of the battery and, more importantly, can increase the risk that the battery will become so weak that it will not permit use of the firearm at a critical juncture. The spring used in the Shaw, Jr. in conjunction with a conventional DC solenoid is typically weak, and, as a result, the steel pin can be easily pulled away from the hammer.

Accordingly, it would be highly desirable to provide an electrically operated hand gun locking system which consumed only small amounts of electrical energy and which significantly reduced the risk that a battery which provided the electrical energy would become inoperative due to extended use of the hand gun or other hand held weapon.

Therefore, it is a principal object of the invention to provide an improved method and apparatus for preventing the unauthorized use of a hand held weapon.

A further object of the invention is to provide an electrically operated apparatus which prevents the unauthorized discharge of a hand held weapon and which consumes only small amounts of electrical energy.

Still another object of the invention is to provide an improved safety lock apparatus which will permit discharge of a hand held weapon only at designated times of day and which includes an alarm that is activated when the safety apparatus is unlocked.

These and other, further and more specific objects and advantages of the invention will be apparent to those skilled in the art from the following detailed description thereof, taken in conjunction with the drawings, in which:

FIG. 1 is a side view illustrating a firearm equipped with a safety locking system constructed in accordance with the principles of the invention;

FIG. 2 is a side view of a cylindrical magnet utilized in the safety locking system of FIG. 1;

FIG. 3 is a side view illustrating a locking pin or member which utilizes the magnet of FIG. 2 and illustrating the electromagnetic apparatus utilized to displace the locking pin between two operative positions;

FIG. 4 is a side view of the apparatus of FIG. 3 illustrating the mode of operation thereof;

Figure 5:
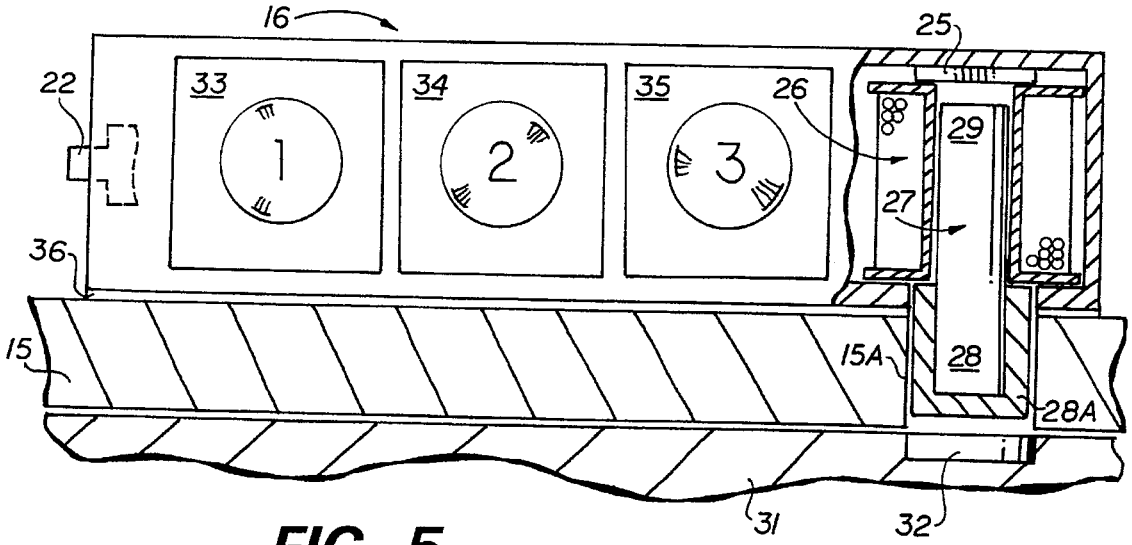
FIG. 5 is a side section view illustrating further construction details of the locking pin control box of FIG. 1.

Briefly, in accordance with the invention, I provide an improved safety system for a hand held weapon. The weapon includes a firing system including a trigger, a hammer, and a linkage interconnecting the trigger and the hammer. The improved safety system prevents the unauthorized firing of the hand held weapon and includes a first member which attracts a magnet; a second member which attracts a magnet; a control member; and a system for producing an electromagnetic field. The control member includes a magnet. The magnet has first and second ends and is moveable between at least two operative positions a first operative position and a second operative position. In the first operative position, the magnet prevents the normal operation of the firing system, and the first end of the magnet is attracted to the first member to maintain the control member in the first operative position. In the second operative position the magnet permits the normal operation of the firing system and the second end of the magnet is attracted to the second member to maintain the control member in the second operative position when said control member is in the second operative position. The improved safety system also includes means adjacent the control member to produce an electromagnetic field which interacts with at least one magnetic field in the magnet to move the magnet from the first to the second operative position.

In another embodiment of the invention, I provide an improved electrical relay system. The relay system includes an electrical path having a first end and a second end; a first contact attached to the first end of the path; and, a second contact attached to said second end of the path and moveable between at least two operative positions, a primary operative position with the second contact spaced apart from the first contact, and a secondary operative position with the second contact contacting the first contact to close the path and form a complete continuous circuit for an electric current. The relay system also includes a device for moving the second contact from the first to the second operative position. The device includes a attractant member which attracts a magnet; a control member including a magnet having first and second ends and at least north and south magnetic poles and moveable between at least first and second operative positions. In the first operative position the first end is at least two operative positions. In the first operative position the first end is spaced apart from the attractant member. In the second operative position the first end is displaced toward the attractant member such that the control member displaces the second contact from the primary operative position to the secondary operative position, and first end is attracted to the attractant member to maintain the control member in the second operative position. The device also includes means adjacent the control member to produce an electromagnetic field which interacts with at least one magnetic field in the magnet to move the magnet from the first to the second operative position.

Turning now to the drawings which depict the presently preferred embodiments of the invention for illustrating the practice thereof, and not by way of Limitation of the scope of the invention, and in which like reference characters refer to corresponding elements throughout the several views, FIGS. 1 to 5 illustrate a safety lock system for a hand held weapon constructed in accordance with the principles of the invention. The safety lock system in used in combination with a hand gun 10 having a hammer 11, trigger 13, linkage assembly 12 interconnecting the trigger 13 and hammer 31, trigger guard 14, side plate 15, and handle 21. The safety system includes a lock box 16, microprocessor 18, battery 19 connected to microprocessor 18, electrical interconnect 17 extending from box 16 to microprocessor 18, an alarm 20, and a LED 22 connected to microprocessor 18. A lock pin assembly is mounted in box 16 and is illustrated in FIGS. 3 to 5. The lock pin assembly includes a cylindrical rare earth neodymium-iron-boron magnet 27 having a south pole 28 and a north pole 29. The south pole 28 of the magnet is covered by hollow cylindrical sleeve 28A. Sleeve 28A is fabricated from a non-ferrous metal which cannot become a magnet and which protects magnet 27. Magnet 27 and sleeve 28A together functions as the lock pin.

In FIG. 3, magnet 27 and sleeve 28A are shown in a first operative position with end 29 sufficiently adjacent to steel plate 25 such that the magnetic field emanating from end 29 draws magnet 27 in the direction of arrow A toward plate 25 to maintain magnet 27 in the position shown in FIG. 3. Magnet 27 is in the first operative position in FIG. 5.

In FIG. 4, magnet 27 and associated sleeve 28A are shown in a second operative position with magnet 27 and sleeve 28A displaced away from plate 25 in the direction of arrow B. In FIG. 4, end 29 is far enough away from plate 25 such that the magnetic field emanating from end 29 does not draw magnet 27 in the direction of arrow A toward plate 25. Instead, in FIG. 3 the upper portion of sleeve 28A is seated in the cylindrical groove 32 formed in hammer 31. Magnet 27 is moved from the first operative position of FIG. 3 to the second operative position of FIG. 4 by activating coil 26 to produce an electromagnetic field which opposes the magnetic field in end 29 and causes magnet 27 to move in the direction of arrow B. In FIG. 4, the magnetic field in the end 28 of magnet 27 is attracted to the steel hammer 31. This attraction forces sleeve 28A into groove 32 and maintains magnet 27 and sleeve 28A in the position shown in FIG. 4. When magnet 27 is in the position shown in FIG. 4, hammer 31 is prevented from moving and the weapon 10 cannot be discharged.

In order to move magnet 27 from the position shown in FIG. 4 to the position shown in FIG. 3, coil 26 is activated to produce a magnetic field which attracts the magnetic field in end 29 and pulls magnet 27 away from hammer 31 and back to the position shown in FIG. 3. A principal advantage of the invention is that once magnet 27 is in its desired operative position, whether it be the position of FIG. 3 or FIG. 4, the electrical energy utilized to activate coil 26 is turned off and the magnetic attraction of magnet 27 to steel plate 25 or hammer 31 maintains the magnet 27 in the desired position. Consequently, coil 26 is operated only for short periods of time and consumes only minimal amounts of electrical energy from battery 19.

Buttons 33, 34, 35 are used to enter a three digit code into the memory of microprocessor 18. The code is entered by depressing any of buttons 33, 34, 35 a total of three times and by then depressing button 33 twice. For example, the code 231 is entered by depressing buttons 34, 35, 33 and then depressing button 33 twice.

Microprocessor 18 activates coil 26 to move magnet 27 from the first operative position of FIG. 3 to the second locking operative position of FIG. 4 when any one of buttons 33 to 35 is depressed. Microprocessor 18 activates coil 26 and reverses the polarity of coil 26 to move magnet 27 from the second locking operative position of FIG. 4 to the unlocked operative position of FIG. 3 only when the proper code, for example code 231 noted above, is inserted using buttons 33 to 35. After code 231 is inserted, then microprocessor 18 activates the LED 22 to indicate that magnet 27 is in the unlock position. If the incorrect code is inserted, microprocessor 18 causes audio alarm 20 to sound.

As shown in FIG. 1, alarm unit 20, battery 19, and microprocessor 18 are mounted in the hollow handle 21 of weapon 10. Battery 19 powers microprocessor 18, alarm 20, lock box 16, and red LED 22.

FIG. 5 illustrates lock box 16 attached to side plate 15. Box 16 can be attached to plate 15 by using lock tabs on box 16 which snap into lock slots formed through plate 15. An EDM (electric discharge machine) or any other desired apparatus can be used to form the lock slots through plate 15, to form cylindrical sleeve opening 15A, and to form the cylindrical aperture 32 in the hammer 31. An EDM can burn out precision holes in hardened steel by using a preformed graphite electrode. Box 16 can also be attached to plate 15 by using a layer of solder or adhesive 36. Cylindrical opening 15A slidably receives sleeve 28A to permit sleeve 28A to move toward and away from aperture 32.

FIG. 5 illustrates a layer of solder or adhesive 36 used to secure lock box 16 to plate 15 and illustrates the cylindrical opening 15A formed through plate 15 to slidably receive cap 28A and permit cap 28A to move toward and away from aperture 32.

In use of the safety system shown in FIGS. 1 to 5, buttons 33, 34, 35 are used to enter a code in the memory of microprocessor 18. After the code is entered, depressing any of buttons 33, 34, 35 causes microprocessor 18 to activate coil 26 and reverse the polarity of coil 26 to move magnet 27 from the operative position of FIGS. 3 and 5 to the locking operative position shown in FIG. 4. When the correct three digit code is sequentially entered in lock box 16 by depressing buttons 33, 34, 35 three times in the correct sequence, then microprocessor activates coil 26 to produce an electromagnetic field which interacts with at least one magnetic field from magnet 27 to move magnet 27 from the operative position of FIG. 4 back to the operative position shown in FIGS. 3 and 5. Electrical power from battery 19 is only required for short periods of time while magnet 27 is being moved between the operative positions of FIGS. 3 and 4.

The microprocessor 18 has a twenty-four hour timing cycle which can be programmed to lock and unlock box 16 automatically. To enter the automatic unlocking mode, buttons 33 and 34 are depressed and released simultaneously. Alarm 20 chirps a few times to confirm that the automatic unlocking mode has been initially activated. To set the desired unlocking time of day, button 35 is pressed once for each hour desired beyond the present time of day. For example, if the time of day is 6:00 pm when buttons 33 and 34 are simultaneously pressed to enter the automatic unlocking mode, then pressing button 35 four times indicates that the lock box 16 should unlock at 10:00 pm. Each time button 35 is pressed, LED 22 flashes. To enter the automatic locking mode, buttons 34 and 35 are again simultaneously depressed at the same time. When buttons 34 and 35 are again simultaneously depressed, microprocessor 18 causes alarm 20 to chirp a few times to indicated that the autolock mode is entered. To set the desired locking time of day, button 35 is pressed once for each hour desired beyond the present time of day. For example, if the time if day is 6:00 pm when buttons 33, 34 are simultaneously pressed to enter the automatic locking mode, then pressing button twelve times indicates that the lock box 16 should lock at 6:00 am. LED 22 flashes each time button 33 is depressed. To override the automatic lock or unlock modes, the combination code to unlock box 16 is entered using buttons 33 to 35. When the combination code is entered, the automatic lock and unlock times are erased.

Magnet 27 is sized such that only about one-half the length L (FIG. 4) of magnet 27 will be in coil 26 before magnetic fields of like poles collide and prevent the further movement of magnet 27.

Alarm 20 presently sounds within ten seconds only if someone tampers with the buttons 33, 34, and 35 by entering an incorrect combination.

As earlier noted, the control box 16, microprocessor 18, battery 19, and alarm 20 can be mounted and work on hand-held weapons in which a pin 27 can prevent the firing of the weapon. Such hand-held weapons include, without limitation, revolvers, semi-automatic hand guns, bolt action rifles, semi-automatic or fully automatics weapons, pump action rifles, and shotguns.

An alternate safety unit 40 of the invention is illustrated in FIGS. 6 to 9 and can be retrofit on existing weapons 37 having a trigger 38, trigger guard 39 and handle 51. Unit 40 includes a housing having arcuate side panels 42 and 52, oval end panels 92 and 93, and oval layer 53 of stiff foam rubber. A thin arcuate groove 41 is formed in the foam rubber layer 53. Groove 41 is contoured to frictionally receive and support the trigger guard 39 of weapon 37 in the manner shown in FIG. 6. When the locking pin 56 is in the position shown in FIG. 9, end 43 of pin 56 extends through trigger guard 39 and prevent unit 40 from being removed from the trigger guard 39. Control box 46 is mounted on the housing and includes twelve buttons 47 numbered like the buttons on a touch tone telephone, an alarm 50, and a red and green LED 48, 49. When depressed, the buttons generate input signals received by a microprocessor 45 in box 46. Microprocessor 45 operates the coil 44 which displaces pin 56, operates the alarm 50 mounted in the control box 46, and operates the red LED 48 and the green LED 49. LEDs 48, 49, when lit, each tell the user that pin 56 has reached a desired operative position. Only one LED 48, 49 is lit at any given time.

Figure 6:
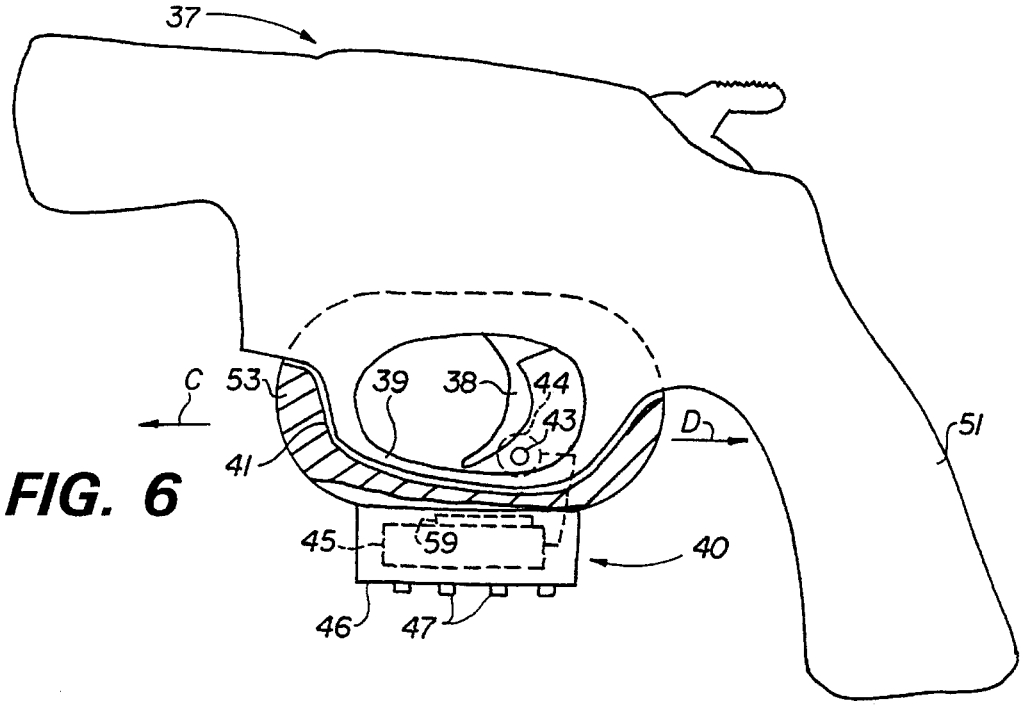
FIG. 6 is a side view illustrating a firearm equipped with an alternate embodiment of the invention.
Figure 7:
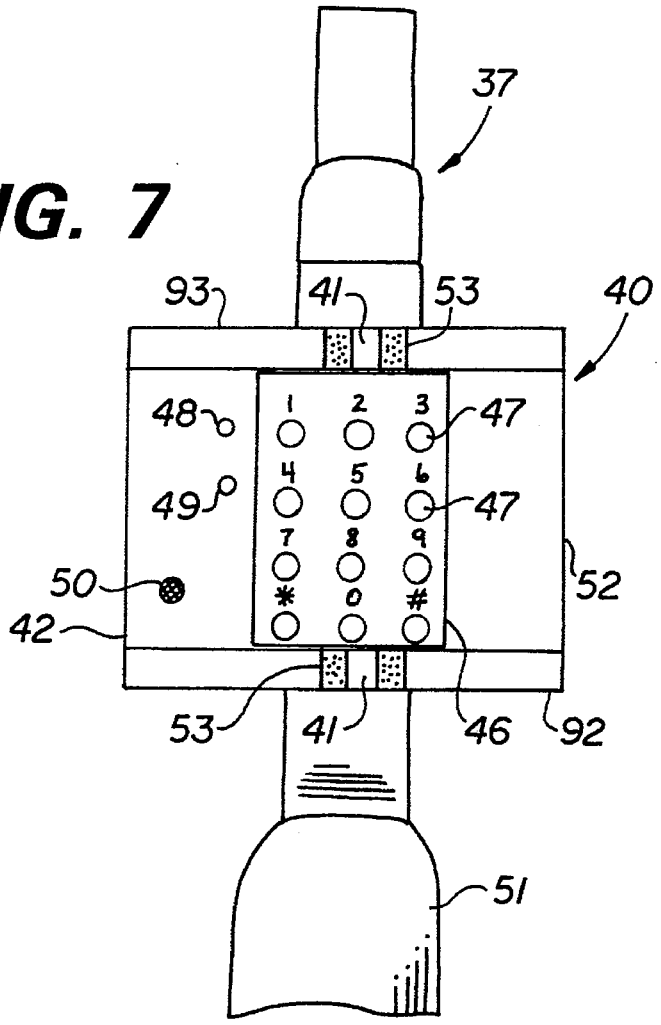
FIG. 7 is a bottom view illustrating the embodiment of the invention of FIG. 6.
Figure 8:
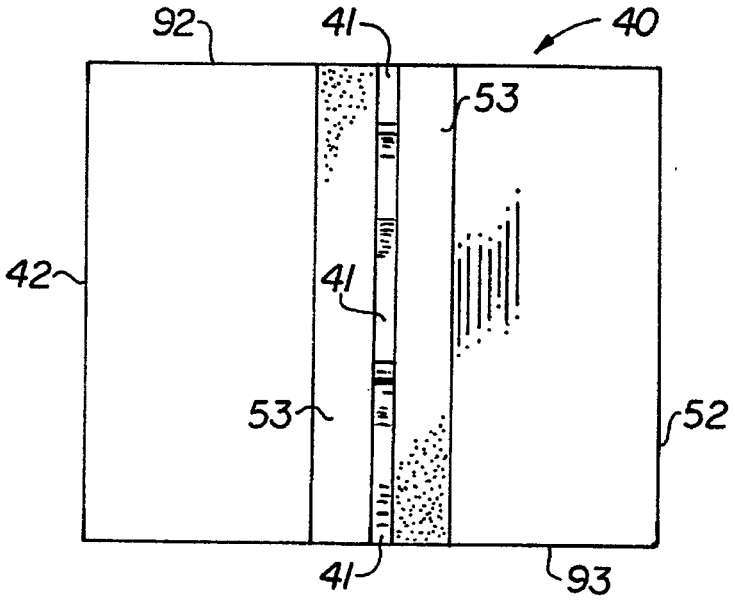
FIG. 8 is a top view illustrating the embodiment of the invention of FIG. 7.

In operation of the embodiment of the invention illustrated in FIGS. 6 to 9, the slot 41 in foam rubber 53 is slipped over trigger guard 39 to the position shown in FIGS. 6 and 7. Buttons 47 are pushed three times in sequence, followed by depressing the "*" button to enter a code in microprocessor 45. For example, if buttons "4", "1", "8", and "*" are pressed, the control code 418 is entered in microprocessor 45. As soon as the control code is entered in microprocessor 45, depressing any of buttons 47 causes pin 56 to be displaced from a first operative position with end 54 against contact 64 to the second operative position shown in FIG. 9. As earlier noted, when pin 56 is in the position shown in FIG. 9, the safety unit 40 cannot be removed from trigger guard 39 because pin 43 contacts and extends through the trigger guard 39. Further, when pin 56 is in the position shown in FIG. 9, pin 56 prevents trigger 38 from operating and, accordingly, prevents the firing of weapon 37. The proper contouring of groove 41 to engage snugly and firmly trigger guard 39 and/or trigger 38 is important because once the safety unit 40 is mounted on weapon 37 in the position shown in FIG. 6, lateral displacement of unit 40 in the directions of arrow C and D must be prevented, or at least minimized so that end 43 of pin 56 remains in the position shown in FIG. 6 and prevent operation of trigger 38.

Buttons 47 can also, if desired, be utilized to enter a time period during each day (or year, month, hour, etc.) when the unit 40 cannot be unlocked and removed from trigger guard 39. The microprocessor 45 has a twenty-four hour timing cycle and is programmable to lock and unlock automatically unit 40. To enter the automatic unlocking mode the "#" button is depressed and released. The alarm 50 chirps a few times to indicate to the user that the automatic unlock mode has been entered. To set the desired unlocking time of day, a pair of buttons are pressed to indicates the number of hours desired beyond the present time of day. For example, if the time of day is 6:00 pm when buttons 33 and 34 are simultaneously sequentially depressed and released to enter the automatic unlocking mode, then pressing the "0" and "4" buttons indicates that the lock box 16 should unlock in four hours at 10:00 pm. After buttons "0" and "4" are depressed, LED 22 flashes. To enter the automatic locking mode, button "*" is depressed and released. When the "*" button is depressed, microprocessor 18 causes alarm 20 to chirp a few times to indicated that the automatic locking mode is entered. To set the desired locking time of day, a pair of buttons are pressed to indicates the number of hours desired beyond the present time of day. For example, if the time of day is 6:00 pm when buttons 33 and 34 are simultaneously sequentially depressed and released to enter the automatic unlocking mode, then pressing the "1" and "2" buttons indicates that the lock box 16 should lock in twelve hours at 6:00 pm. After the buttons "1" and "2" are depressed, LED 22 flashes. To override the automatic lock or unlock modes, the combination code to unlock unit 40 is entered by depressing the appropriate buttons. When the combination code is entered, the automatic lock and unlock times are erased and unit 40 is unlocked.

Figure 9:
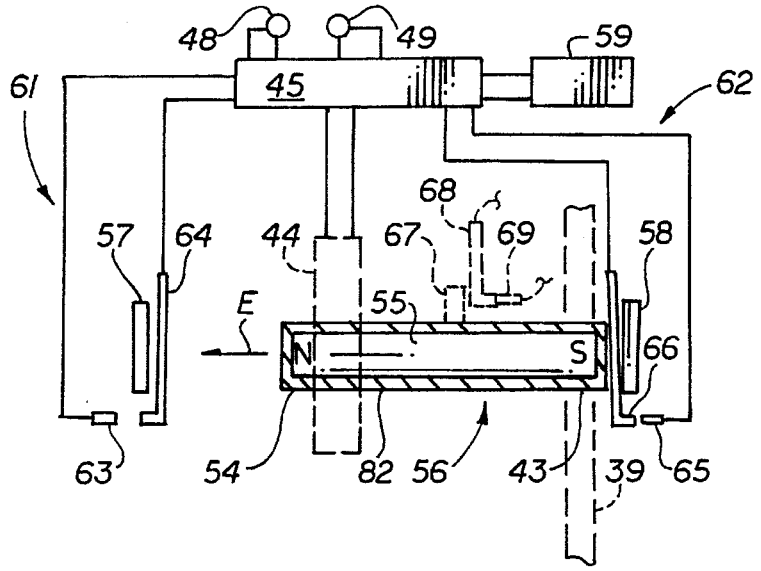
FIG. 9 is a schematic diagram illustrating a relay used in conjunction with the invention.

In addition to locking unit 40 in position on trigger guard 39, pin 56 also functions as a relay in the manner illustrated in FIG. 9. As shown in FIG. 9, pin 56 includes cylindrical rare earth magnet 55 housed in a hollow, cylindrical non-ferrous sleeve 82. Sleeve 82 includes one end 43 covering the south pole of magnet 55 and includes a second end 54 covering the north pole of magnet 55. Coil 44 is activated by microprocessor 45 to produce electromagnetic fields which interact with pin 56 to move pin 56 between the first operative position shown in FIG. 9 and a second operative position in which pin 56 is displaced in the direction of arrow E in FIG. 9 to a position in which end 54 depresses contact 64 in the direction of arrow E against contact 63 to close circuit 61 and sends a signal to microprocessor 45 to cause red LED 48 to light and flash. When red LED 48 is flashing, or is emanating light, then the user knows that pin 56 is in the second operative position and that unit 40 is not locked on trigger guard 39. When pin 56 is in the first operative position shown in FIG. 9, end 43 bears against contact 66 and forces contact 66 against contact 65 to close circuit 62 and sends a signal to microprocessor 45 to cause green LED 49 to turn on and flash. When green LED 49 is flashing, the user knows that pin 56 is in the first operative position and that unit 40 is locked onto trigger guard 39. Circuit 62 includes LED 49, microprocessor 45, battery power 59, and contacts 66 and 65. Circuit 61 includes LED 48, microprocessor 45, battery power 59, and contacts 63 and 64.

When pin 56 is in the first operative position shown in FIG. 9 with end 43 bearing against contact 66, steel plate 58 attracts pin 56 because the magnetic field emanating from the south pole of magnet 55 draws magnet 55 against contact 66 and toward plate 58. The position of contact 66 can be varied as desired. For example, in FIG. 9, contacts 66 and 65 can be replaced in circuit 62 by contacts indicated by dashed lines 68 and 69. Contact 68 comprises a resilient arm like contact 66. When contact 68 is displaced against contact 69 in the manner shown in FIG. 9, then circuit 62 is closed. Arm 67 attached to pin 56 contacts and displaces contact 68 against contact 69 when pin 56 is in the position shown in FIG. 9 with the south end of magnet 55 adjacent plate 58. When pin 56 is displaced in the direction of arrow E, arm 67 moves away from contact 68 and contact 68 resiliently separates from contact 69 in the direction of arrow E to a position short distance away from contact 69 to open circuit 62.

When pin 56 is in the second operative position with end 54 bearing against contact 64, steel plate 57 attracts pin 56 because the magnetic field emanating from the north pole of magnet 55 drawings magnet 55 against contact 64 and toward plate 57. When coil 44 is activated, an electromagnetic field can be generated which is sufficient to interact with a magnetic field in magnet 55 and pull end 43 in the direction of arrow E away from plate 58 and from contact with contact 66. Similarly, when coil 44 is activated, an electromagnetic field can be generated which is sufficient to interact with a magnetic field in magnet 55 and pull end 54 in a direction opposite that of arrow E and away from plate 57 and from contact with contact 64. As would be appreciated by those of skill in the art, reversing the polarity of a coil 26, 44 determines whether the coil will "push" or "pull" the north pole (or south pole) magnetic field of a magnet 27, 55. A microprocessor 18, 45 used in the practice of the invention controls the movement of a magnet 27, 55 by controlling the polarity of the coil 26, 44.

The alarm 50 will sound within ten seconds if someone tampers with the buttons 47 by entering the incorrect combination.

About one-half of the length of magnet 55 moves into coil 44 toward plate 57 before magnetic fields of identical polarity become adjacent one another and prevent further movement of magnet 55.

Figure 10:
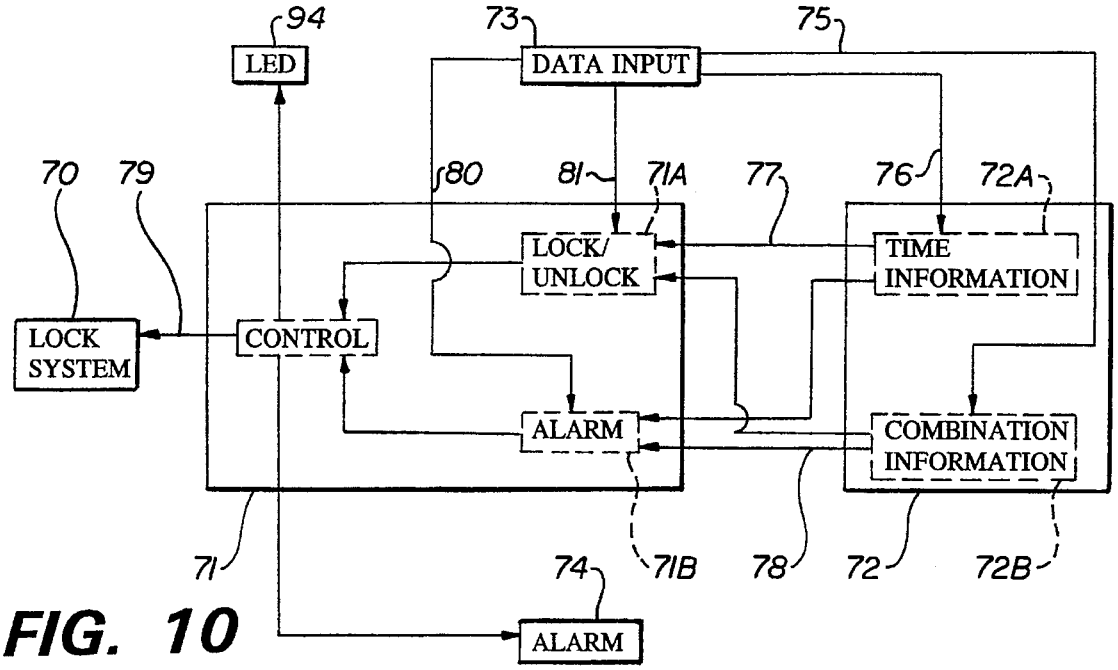
FIG. 10 is a block diagram illustrating an improved weapon safety locking system embodying the present invention; and, FIG. 11 is a perspective view further illustrating the embodiment of the invention of FIGS. 6 to 8.
Figure 11:
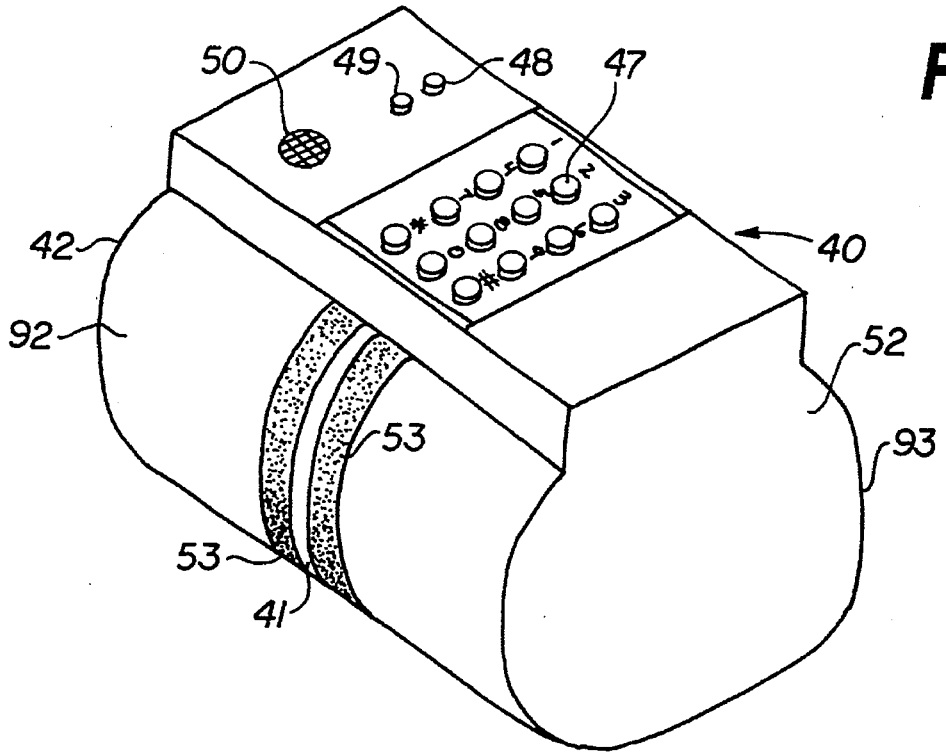

A block diagram of the safety lock system of the invention is illustrated in FIG. 10 and includes a lock system 70 (for example, the lock system shown in FIGS. 3 to 5), a lock system controller 71 and a memory 72. The controller 71 and memory 72 are contained in, for example, a microprocessor 18. A data input 73 and alarm 74 are provide. The data input 73 can, for example, be the buttons 33 to 35 which generate signals received by microprocessor 18. After microprocessor 18 receives the signals, microprocessor 18 activates LEDs 48 and/or 49. Alarm 74 can be an audio alarm 20 or other kind of alarm.

As indicated by the dashed lines 71A and 71B, the controller performs the dual function of locking and unlocking 71A system 70 and of activating 71B the alarm. The memory contains both time information 72A and combination or code information 72B. The time information is information which defines a period of day during which a safety unit 40 can or cannot be removed from a weapon. One procedure for entering such time period information into the memory 72 of a microprocessor was earlier described. The combination information 72B consists of a code which must be entered into the safety system of the invention before the system will operate the lock system 70 to permit the firing of the weapon using the safety lock system of the invention. As described above, one method of entering such a code is to utilize push buttons 47, 33 to 35. Any other desired method can be used.

Locking unit 40 can, as earlier noted, be utilized on any type of hand-held weapon in which a locking pin 56 can be utilized to prevent the firing or activation of the weapon.

In use of the safety system illustrated in FIG. 10, data input 73 is used to input 75, 76, 80, 81 code and time data to combination information 72B, time information 72A, alarm sub-routine 71B, and lock/unlock sub-routine 71A, respectively. Time information 72A and combination information 72B is transmitted 77 to the lock/unlock subroutine 71A when the controller 71 is determining whether the lock system is to be locked or unlocked. For example, as earlier described, after a three digit code is entered using buttons 33 to 35, any button 33 to 35 is depressed to cause controller 71 to signal 79 system 70 to lock and to activate the red LED 94. Similarly, time information and combination information from memory 72 can be transmitted 78 to and utilized by the alarm sub-routine 71B when the controller 71 is utilizing the alarm sub-routine 71B to determine whether to activate alarm 74. If, for example, an individual attempts to enter the improper code with buttons 47 during the time period when the unit 40 cannot be taken off of a firearm 37, then the controller 71 can activate an alarm 74 which is part of the safety lock system of the invention.

Having described my invention in such terms as to enable those skilled in the art to understand and use it, I claim:

1. In combination with a hand held weapon including a firing system including trigger means, hammer means, and linkage means interconnecting said trigger means and said hammer means, the improvements comprising safety means for preventing the unauthorized firing of the hand held weapon, said safety means including (a) a first member which attracts a magnetically polarized member;

(b) a second member which attracts a magnetically polarized member;

(c) a control member including a magnet having first and second ends and moveable between at least two operative positions (i) a first operative position to prevent the normal operation of the firing system, said first end being magnetically attracted to said first member to maintain said control member in said first operative position when said control member is in said first operative position, and (ii) a second operative position to permit the normal operation of the firing system, said second end being magnetically attracted to said second member to maintain said control member in said second operative position when said control member is in said second operative position;

(d) electrically activated means adjacent said control member to produce a first electromagnetic field which interacts with at least one magnetic field in said magnet to move said magnet from said first to said second operative position, said magnetic field being in said first end of said magnet;

(e) a source of electricity; and, (f) supply means for (i) providing to said electrically activated means electricity from said source of electricity to produce an electromagnetic field to move said magnet from said first to said second operative position, and (ii) after said magnet has moved from said first to said second operative position, deactivating said electrically activated means by discontinuing the flow of electricity from said source of electricity to said electrically activated means, said second member maintaining said magnet in said second operative position after electricity from said source of electricity has been discontinued to said electrically activated means.

2. The combination of claim 1 wherein (a) said magnetic field in said first end of said control member has a selected polarity; and, (b) said electromagnetic field has a polarity opposite said selected polarity.

3. The combination of claim 2 including means for, when said magnet is in said second operative position, (a) providing to said electrically activated means electricity from said source of electricity to produce a second electromagnetic field to move said magnet from said second to said first operative position, and (b) after said magnet has moved from said second to said first operative position, deactivating said electrically activated means by discontinuing the flow of electricity from said source of electricity to said electrically activated means, said second member maintaining said magnet in said second operative position after electricity from said source of electricity has been discontinued to said electrically activated means.

4. The combination of claim 3 wherein (a) said second electromagnetic field interacts with said magnetic field; and, (b) said second electromagnetic field has said selected polarity.

5. The combination of claim 1 wherein said magnet includes a rare earth magnet and a sleeve enclosing said rare earth magnet.

6. The combination of claim 5 wherein said sleeve is non-ferrous.

7. The combination of claim 1 wherein said first member, second member, control member, electrically activated means, and supply means are permanently mounted on said weapon.

8. In combination with a hand held weapon including a firing system including trigger means, hammer means, and linkage means interconnecting said trigger means and said hammer means, the improvements comprising safety means for preventing the unauthorized firing of the hand held weapon, said safety means including (a) a control member including a magnet having first and second ends and moveable between at least two operative positions (i) a first operative position to prevent the normal operation of the firing system, and (ii) a second operative position to permit the normal operation of the firing system;

(b) electrically activated means adjacent said control member to produce an electromagnetic field which interacts with at least one magnetic field in said magnet to move said magnet from said first to said second operative position;

(c) a source of electricity: and, (d) supply means for (i) providing to said electrically activated means electricity from said source of electricity to produce a first electromagnetic field to move said magnet from said first to said second operative position, and (ii) after said magnet has moved from said first to said second operative position, deactivating said electrically activated means by discontinuing the flow of electricity from said source of electricity to said electrically activated means.

9. The combination of claim 8 wherein (a) said magnetic field is in said first end of said control member and has a selected polarity; and, (b) said electromagnetic field has a polarity opposite said selected polarity.

10. The combination of claim 9 including means for, when said magnet is in said second operative position, (a) providing to said electrically activated means electricity from said source of electricity to produce a second electromagnetic field to move said magnet from said second to said first operative position, and (b) after said magnet has moved from said second to said first operative position, deactivating said electrically activated means by discontinuing the flow of electricity from said source of electricity to said electrically activated means.

11. The combination of claim 10 wherein (a) said second electromagnetic field interacts with said magnetic field; and, (c) said second electromagnetic field has said selected polarity.

12. The combination of claim 8 wherein said magnet includes a rare earth magnet and a sleeve enclosing said rare earth magnet.

13. The combination of claim 12 wherein said sleeve is non-ferrous.

14. The combination of claim 8 wherein said control member, electrically activated means, and supply means are permanently mounted on said weapon.

15. In combination with a hand held weapon including a firing system including trigger means, hammer means, and linkage means interconnecting said trigger means and said hammer means, the improvements comprising a portable self-contained safety means mountable on the weapon to prevent the unauthorized firing of the weapon, said safety means including (a) a housing;

(b) a control member mounted in said housing and including a magnet having first and second ends and moveable between at least two operative positions (i) a first operative position to prevent the normal operation of the firing system, and (ii) a second operative position to permit the normal operation of the firing system;

(c) electrically activated means mounted in said housing adjacent said control member to produce an electromagnetic field which interacts with at least one magnetic field in said magnet to move said magnet from said first to said second operative position;

(d) a source of electricity mounted in said housing; and, (e) supply means mounted in said housing for (i) providing to said electrically activated means electricity from said source of electricity to produce an electromagnetic field to move said magnet from said first to said second operative position, and (ii) after said magnet has moved from said first to said second operative position, deactivating said electrically activated means by discontinuing the flow of electricity from said source of electricity to said electrically activated means.

16. The combination of claim 15 wherein said trigger means includes a trigger guard and said safety means is mountable on said trigger guard to prevent operation of said trigger means to fire the weapon.

17. The combination of claim 15 wherein said source of electricity is a battery.

18. The combination of claim 15 wherein said magnet includes a rare earth magnet and a sleeve enclosing said rare earth magnet.

19. The combination of claim 18 wherein said sleeve is non-ferrous.

20. The combination of claim 15 wherein said control member, electrically activated means, and supply means are permanently mounted in said housing.

* * * * *